US006824398B2

(12) United States Patent
Hara

(10) Patent No.: US 6,824,398 B2
(45) Date of Patent: Nov. 30, 2004

(54) STRUCTURE AND METHOD FOR CONNECTING BUS BARS IN ELECTRIC JUNCTION BOX

(75) Inventor: Yasuhiro Hara, Ogasa-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/800,726

(22) Filed: Mar. 16, 2004

(65) Prior Publication Data

US 2004/0185698 A1 Sep. 23, 2004

(30) Foreign Application Priority Data

Mar. 17, 2003 (JP) ..... P2003-071336

(51) Int. Cl.[7] ..... H01R 12/00
(52) U.S. Cl. ..... 439/76.2; 439/949
(58) Field of Search ..... 439/76.2, 949

(56) References Cited

U.S. PATENT DOCUMENTS 6,506,060 B2 * 1/2003 Sumida et al. ..... 439/76.2
6,514,091 B2 * 2/2003 Saito et al. ..... 439/76.2

FOREIGN PATENT DOCUMENTS

JP 2001-309526 A 11/2001
JP 2002-58133 A 2/2002

* cited by examiner

*Primary Examiner*—Tho D. Ta
(74) *Attorney, Agent, or Firm*—Sughrue Mion, PLLC

(57) ABSTRACT

A first assembly includes a board member for wiring an electric wire thereon, and a first bus bar electrically connected to the electric wire. The first bus bar includes a first tab-shaped terminal having a first dimension in a first direction and a second dimension smaller than the first dimension in a second direction perpendicular to the first direction. A second assembly is joined to the first assembly in the first direction. The second assembly includes a mount section in which an electric component is mounted, and a second bus bar electrically connected to the electric component: The second bus bar includes a second tab-shaped terminal having a third dimension in the first direction and a fourth dimension smaller than the third dimension in the second direction. The first terminal and the second terminal are arranged so as to be overlapped in the second direction to be welded to each other, after the second assembly is joined to the first assembly, and arranged such that a relative position between the first terminal and the second terminal is gradually changed in the first direction during the joining operation of the first assembly and the second assembly.

8 Claims, 6 Drawing Sheets

STRUCTURE AND METHOD FOR CONNECTING BUS BARS IN ELECTRIC JUNCTION BOX

BACKGROUND OF THE INVENTION

The present invention relates to a structure and a method for connecting bus bars in an electric junction box for electrically connecting an electric component block such as a fuse block to a circuit board assembly including wiring circuit boards, bus bar circuit boards and so on, by way of bus bars, by welding.

FIGS. 6 and 7 show one example of a conventional connecting structure of bus bars in an electric junction box, which is disclosed in Japanese Patent Publication No. 2001-309526A (cf., Page 3 and FIGS. 1 to 5).

This electric junction box comprises: an assembly 51 of a plurality of bus bar circuit boards which are stacked one on another, a relay block 54 which is connected by welding to terminal portions 53 of bus bars 52 (see FIG. 7) of the circuit board assembly 51; a fuse block 55 which is disposed on the circuit board assembly; and a cover 56 (see FIG. 7) made of synthetic resin for covering a sub assembly of these elements.

Each of the bus bars 52 is formed by stamping an conductive sheet metal into a desired circuit shape, and by bending a desired end portion of the bus bar 52 at a right angle or by extending it straightly to form a terminal portion 53. The terminal portion 53 projects from one side edge of the circuit board assembly 51, and is connected by welding to a terminal portion 57 at one end of bus bar 66 of the relay block 54. Both the terminal portions 53 and 57 are clamped between a pair of electrodes of a resistance welding machine (not shown), and electrically heated to be welded. The relay block 54 is juxtaposed with the circuit board assembly 51.

A terminal portion (not shown) at the other end of the bus bar 66 of the relay block 54 is connected to a relay connecting terminal (not shown) in a relay mounting part 65. Terminal portions 58 projected from edges of the circuit board assembly 51 constitute a fuse connecting part in cooperation with terminal portions 59 of the fuse block 55, for example. A fuse (not shown) having a pair of terminals is connected to the fuse connecting part. The bus bars 60 of the fuse block 55 are connected to vertical terminal portions 62 of the bus bars 61 of the circuit board assembly 51, for example.

Other terminal portions 63 vertically uprighted from the circuit board assembly 51 are contained in a housing part 64 of the cover 56 (see FIG. 7) to constitute a connector or the like. An exterior wire harness (a power source circuit or an auxiliary equipment circuit) is connected to the connector. In this manner, the power source in the exterior, the bus bars, the relays, the fuses and an auxiliary equipment are mutually connected.

However, in the above configuration, when the terminal portions 57 of the relay block 54 are connected to the terminal portions 53 of the circuit board assembly 51, they are positioned and welded by abutting the terminal portions 53, 57 in an L-shape against each other in a direction of their thickness. For this reason, there has been such an anxiety that the terminal portions 53, 57 may be excessively pushed and deformed, resulting in variations in welding strength, and reliability of the electrical connection is liable to be deteriorated.

There has been a further anxiety that when the terminal portions 53, 57 are abutted against each other, the bus bars

66 of the relay block may be pushed in a longitudinal direction and may give bad influences to the terminals in the relay mounting part 65 to deform them. Moreover, since relative position of the circuit board assembly 51 with respect to the relay block 54 is determined by the connecting position between the terminal portions 53 and 57, the positions of the circuit board assembly 51 and the relay block 54 to be fixed to the cover (not shown) may vary due to variations of the connecting position, which leads to an anxiety that an assembling work cannot be conducted smoothly. Further, because it has been difficult to position the terminal portions 57 of the relay block 54 with respect to the terminal portions 53 of the circuit board assembly 51, there has been an anxiety that a lot of trouble and many positioning tools may be required, and connecting workability may be deteriorated.

SUMMARY OF THE INVENTION

It is therefore an object of the invention to provide a structure and a method for connecting bus bars, in which it is possible to reliably perform connections between the bus bars of a circuit board assembly and the bus bars of an electric component block provided with electric components such as relays, fuses.

It is also an object of the invention to provide a structure and a method for connecting bus bars, in which, in which it is possible to smoothly and reliably assemble the electric component block to the circuit board assembly with good workability, without being affected by variations or so in connecting positions between terminal portions of the respective bus bars.

In order to achieve the above objects, according to the invention, there is provided a connection structure in an electric junction box, comprising:

a first assembly, comprising:

a board member, for wiring an electric wire thereon; and a first bus bar, electrically connected to the electric wire, and including a first tab-shaped terminal having a first dimension in a first direction and a second dimension smaller than the first dimension in a second direction perpendicular to the first direction; and a second assembly, joined to the first assembly in the first direction, the second assembly comprising:

a mount section, in which an electric component is mounted; and a second bus bar, electrically connected to the electric component, and including a second tab-shaped terminal having a third dimension in the first direction and a fourth dimension smaller than the third dimension in the second direction, wherein:

the first terminal and the second terminal are arranged so as to be overlapped in the second direction to be welded to each other, after the second assembly is joined to the first assembly, and arranged such that a relative position between the first terminal and the second terminal is gradually changed in the first direction during the joining operation of the first assembly and the second assembly.

In such a configuration, both the first and second terminals will not be affected by a pressure in the second (thickness) direction and bending deformation of the terminals will be prevented. Moreover, because the direction of joining the first and second assemblies is same as the first (widthwise) direction of the terminals, the second assembly will be smoothly joined to the first assembly without being affected by connection between the terminals (that is, the relative position in the joining direction). Therefore, for example, a terminal in the first assembly to be connected to the electric component can be perfectly placed at a predetermined position in the second assembly.

It is preferable that: the first terminal is provided at a side end portion of the first assembly in the second direction, and extending in a third direction orthogonal to the first direction and the second direction; and the second terminal is provided at a side end portion of the second assembly in the second direction, and extending in the third direction.

In such a configuration, it is possible to obtain enough space to weld the terminals extended in the third direction, while reducing the space required for the terminals in the second direction.

Here, it is further preferable that a top end of the first terminal is situated upper than a top face of the first assembly.

In such a configuration, the workability of the welding operation can be further enhanced.

It is also preferable that: the second bus bar includes a joint portion continued from the second terminal and extending in the second direction; and the joint portion is fitted into the mount section in the first direction to receive the electric component.

In such a configuration, even when the terminals are brought into contact with each other in the second direction and a repulsion force is generated therebetween, such a repulsion force will not serve as a force for removing the second bus bar from the second assembly. Therefore, the inadvertent removal of the second bus bar can be avoided.

It is also preferable that: the first bus bar includes a third terminal extending in the first direction; and the third terminal is placed in the mount section to receive the electric component when the second assembly is joined to the first assembly.

In such a configuration, since the direction of entering the third terminal into the mount section is the same as the joining direction of the assemblies, even if the terminals are brought into contact with each other in the second direction and a repulsion force is generated therebetween, such a repulsion force will not affect the joining operation.

It is also preferable that the connecting structure further comprises a positioning member for determining a relative position between the first assembly and the second assembly.

In such a configuration, the joining operation of the assemblies can be performed smoothly and reliably.

According to the invention, there is also provided a method of providing a connection structure in an electric junction box, comprising steps of:

providing a first assembly, comprising:

a board member, for wiring an electric wire thereon; and a first bus bar, electrically connected to the electric wire, and including a first tab-shaped terminal having a first dimension in a first direction and a second dimension smaller than the first dimension in a second direction perpendicular to the first direction; and providing a second assembly, comprising:

a mount section, in which an electric component is mounted; and a second bus bar, electrically connected to the electric component, and including a second tab-shaped terminal having a third dimension in the first direction and a fourth dimension smaller than the third dimension in the second direction;

joining the second assembly to the first assembly in the first direction while a relative position between the first terminal and the second terminal is gradually changed in the first direction; and welding the first terminal and the second terminal which are overlapped in the second direction, after the second assembly is joined to the first assembly.

It is preferable that: the first bus bar includes a third terminal extending in the first direction; and the second bus bar includes a joint portion continued from the second terminal and extending in the second direction. The method further comprises steps of: fitting the joint portion into the mount section in the first direction, before the second assembly is joined to the first assembly; and placing the third terminal in the mount section to receive the electric component when the second assembly is joined to the first assembly.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
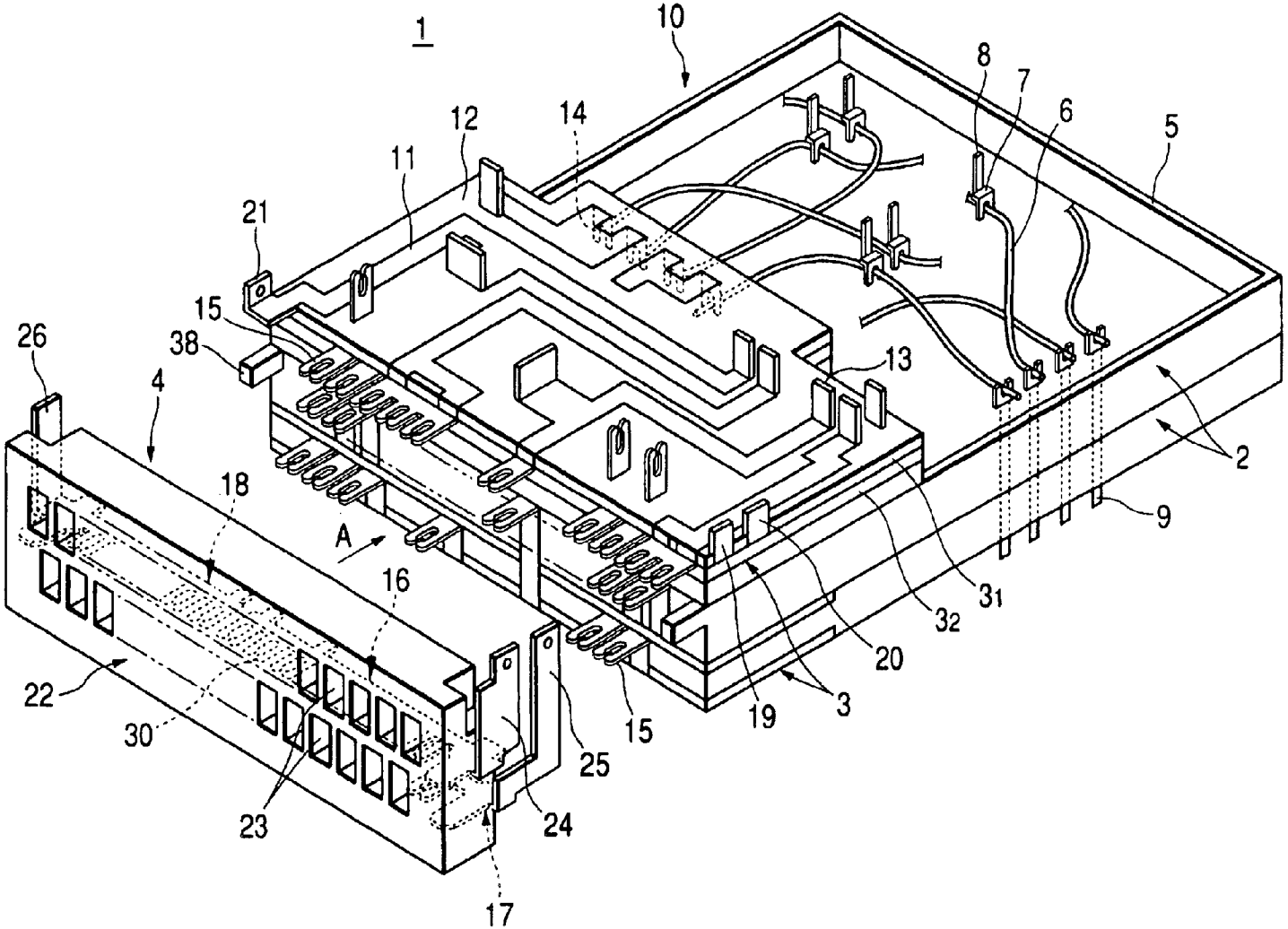
FIG. 1 is an exploded perspective view of a connecting structure of bus bars in an electric junction box according to one embodiment of the invention.

As shown in FIG. 1, this electric junction box comprises: a wiring circuit board 2, a bus bar circuit board 3, and a fuse block (an electric component block) 4 which are assembled into a sub assembly 1; and upper and lower covers (not shown) made of synthetic resin for covering this sub assembly 1.

The wiring circuit board 2 has a flat case 5 made of insulative synthetic resin, and a plurality of electric wires 6 which are arranged in a desired shape in the case 5 and connected to press-fitting terminals 7 disposed inside the case 5. The press-fitting terminals 7 are integrally formed with tab terminals 8 and elongated pin terminals 9. These terminals 8, 9 are contained in a connector housing in the cover to constitute a connector (not shown), or connected to an electronic unit (not shown) inside the cover. In this embodiment, two of the upper and lower wiring circuit boards 2 are provided.

The bus bar circuit boards 3 are stacked in a plurality of layers and integrated with a front half area of the respective wiring circuit boards 2. A circuit board assembly 10 is composed of the wiring circuit boards 2 and the bus bar circuit boards 3. The electric wires 6 of the wiring circuit boards 2 are for a circuit for small current, and bus bars 11 of the bus bar circuit boards 3 are for a circuit for large current such as a power supply. The fuse block 4 is joined to the circuit board assembly 10 in a direction of an arrow mark A (a joining direction).

The bus bar circuit board 3 has an insulative board 12, and a plurality of the bus bars 11 made of conductive material and arranged in a desired shape on a face of the insulative board 12. The bus bars 11 respectively have uprighted tab terminals 13, press-fitting terminals 14 which are bent downward and press-fitted to the electric wires 6 of the wiring circuit board 2, horizontal U-shaped terminals (clamping terminals) 15 for connecting fuses, plate-shaped terminal portions 19–21 which are vertically uprighted and connected by welding to bus bars 16–18 in the fuse block 4.

Figure 2:
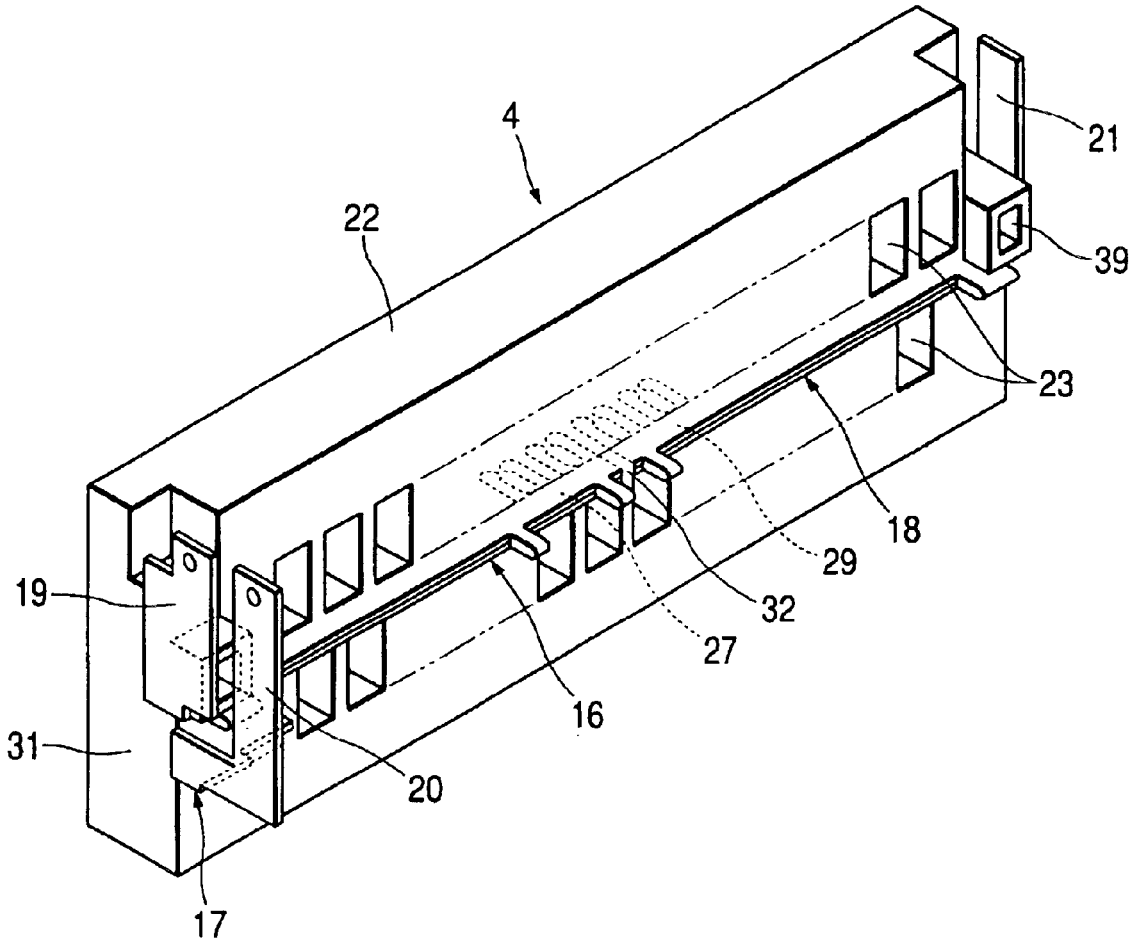
FIG. 2 is a perspective rear view of a fuse block of the electric junction box.

As shown in FIGS. 1 and 2, these terminal portions 1921 to be welded are arranged in right and left ends of the bus bar circuit board 3, and projected higher than the bus bar circuit board $\mathbf{3}_1$ in the uppermost layer. The terminal portions 19 and 20 at the right side (in FIG. 1) are uprighted from the bus bars of the bus bar circuit board $\mathbf{3}_2$ in the second layer from the top, and juxtaposed in the front-rear direction. The terminal portion 21 at the left side (in FIG. 1) is uprighted from a front end part of the uppermost bus bar circuit board $\mathbf{3}_1$.

The terminal portions 19, 20 at the right side are located along a side face of the bus bar circuit board 3 such that outer faces of the terminal portions 19, 20 are made flush with the side face of the bus bar circuit board 3. Similarly, an outer face of the terminal portion 21 at the left side is made flush with the other side face of the bus bar circuit board 3 while being projected slightly forward from a front edge of the bus bar circuit board 3. The bus bar having the front terminal portion 19 is continued to the clamping terminal 15 in a forward area, and the bus bar having the rear terminal portion 20 is continued to a backward area (for example, an area where the electric wires are press-fitted).

Figure 3:
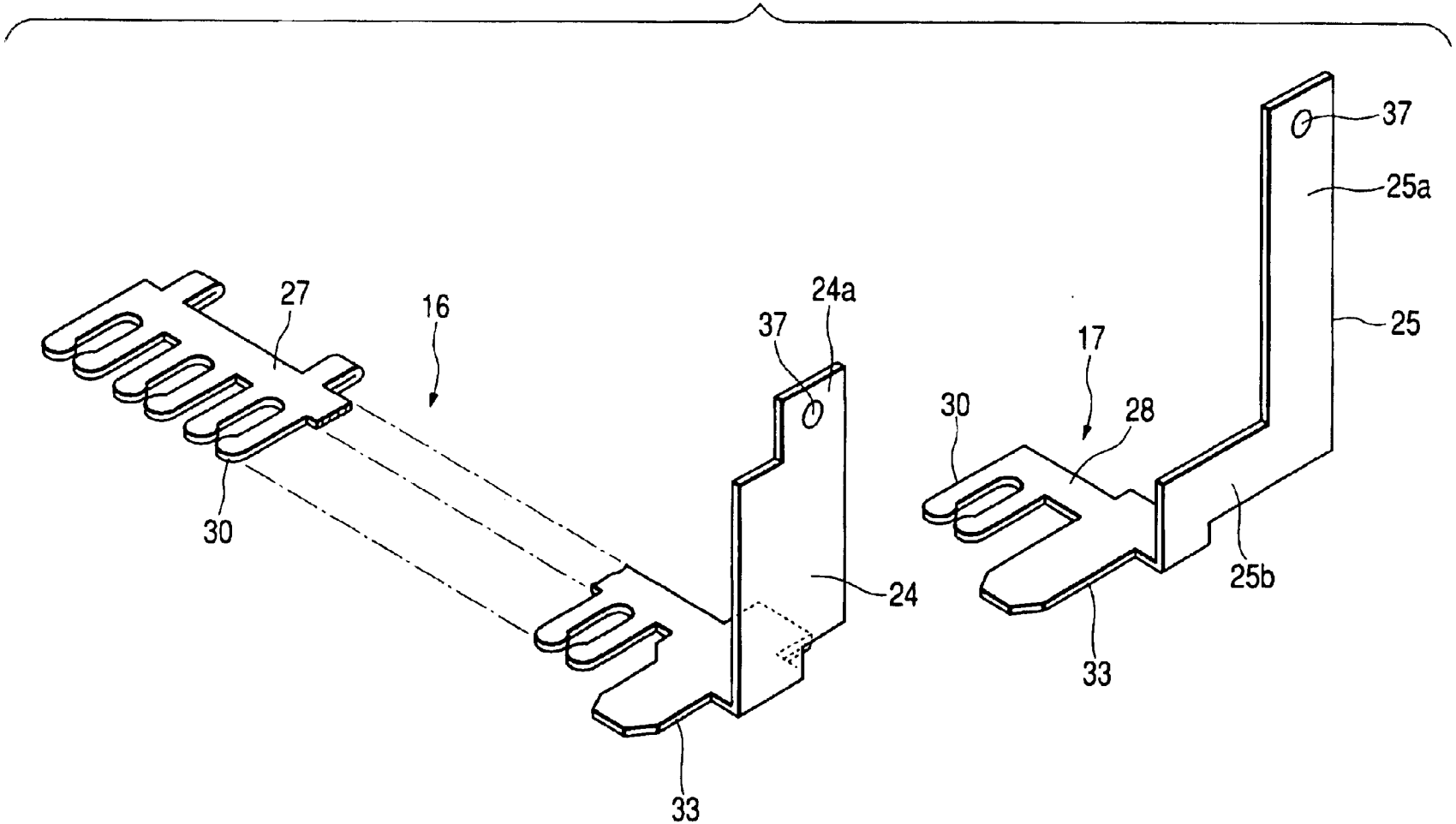
FIG. 3 is a perspective view of the bus bars contained in the fuse block.

The fuse block 4 comprises a block body 22 made of insulative resin; a short bus bar 17; and long bus bars 16, 18. The block body 22 in this embodiment has a plurality of fuse chambers (electric component chambers) 23 arranged in parallel to form two upper and lower rows. As shown in FIG. 3, the bus bars 16–18 are provided with vertical terminal portions 24–26 to be subjected to the welding; and fuse connecting portions point portions) 27, 28 which are bent from the terminal portions 24–26 and extend horizontally. Since the joint portions 27 of a pair of the long right and left bus bars 16, 18 have substantially the same shape, the bus bar 18 at the left side is omitted in FIG. 3.

The terminal portions 24–26 are positioned along both sides of the block body 22. The terminal portions 24, 25 at the right side are juxtaposed in the front and the back. The joint portion 27 continued from the front terminal portion 24 is positioned at upper edges of the fuse chambers 23 in the lower row (see FIG. 2), and has a plurality of U-shaped terminals (clamping terminals) 30 which are arrayed at an equal pitch and adapted to enter into the respective fuse chambers 23. The joint portion 27 continued from the front terminal portion 24 is contained in a slit 32 which extends horizontally from a side wall 31 (see FIG. 2) of the block body 22. The joint portion 29 (see FIG. 2) of the bus bar 18 is contained in this slit 32 in symmetry with the joint portion 27 of the bus bar 16. Direction of inserting the fuse connecting portions 27–29 of the bus bars 16–18 matches with a direction of width of the terminal portions 24–26 and a direction of inserting the clamping terminals 15, 30.

As shown in FIG. 3, the rear terminal portion 25 at the right side of the fuse block 4 is formed in an L-shape having a vertical portion 25*a* and a horizontal portion 25*b*, and a lower part of a tip end of the horizontal portion 25*b* is perpendicularly bent to be continued to a short fuse connecting portion 28. The fuse connecting portion 28 has only one clamping terminal 30 and only one tab portion 33. The tab portion 33 is also provided on the fuse connecting portion 27 continued from the front terminal portion 24. The tab portions 33 serve as a positioning and retaining member for the block body 22.

Figure 4:
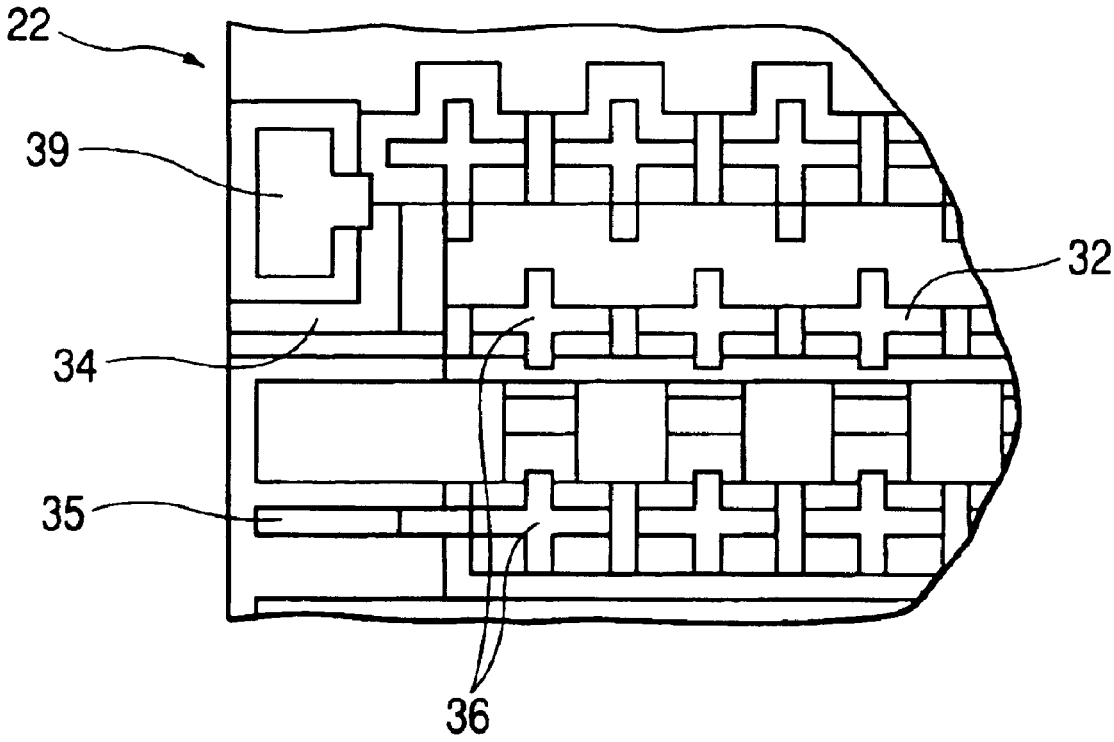
FIG. 4 is a rear view of a block body of the fuse block.

As seen on a back face (an inner face) of the block body 22 as shown in FIG. 4, the respective tab portions 33 are introduced into upper and lower slots 34, 35 to be engaged therewith. The respective clamping terminals 30 are introduced into slots 36 which are juxtaposed to the slots 34, 35. The joint portions 27, 29 of a pair of the right and left bus bars 16, 18 are stacked one on another and inserted into the slit 32 in a press-fitting manner without a clearance.

In FIG. 1, the front and rear terminal portions 24, 25 of the fuse block 4 aligned on the same vertical plane as in the terminal portions 19, 20 of the circuit board assembly 10. Respective upper ends of the terminal portions 24, 25 are extended to the same height and formed with protrusions (indents) 37 for welding are formed by swelling inwardly (see FIG. 3). The bus bar 18 at the left side has a substantially symmetrical shape to the long bus bar 16 at the right side. The terminal portion 26 at the left side straightly extends upwardly along a side face of the block body 22, and is located in substantially symmetry with the front terminal portion 24 at the right side. The block body 22 is partly cut out so that at least top end parts of the front terminal portions 24, 26 are exposed to the exterior to a large extent, as shown in FIG. 1.

As shown in FIG. 3, the front terminal portion 24 at the right side is enlarged in width in the joining direction in comparison with the rear terminal portion 25, and has an upwardly projected part 24*a* in a rear half portion thereof. Different from the terminal portion 26 at the left side, the terminal portion 24 has the protrusion 37 in the projected part 24*a*. Shapes, sizes, etc. of these terminal portions 24–26 can be appropriately determined according to configurations of the fuse block 4, the terminals 15 on the bus bar circuit boards 3, and so on.

At least a pair of right and left positioning projections 38 are provided at a front end face of the wiring circuit board 2 (see FIG. 1), and a pair of right and left recesses 39 adapted to be engaged with the projections 38 are provided in the fuse block 4 (see FIGS. 2 and 4). The recesses 39 are positioned directly above the joint portions 27, 29 of the right and left bus bars 16, 18, and peripheral walls of the respective recesses 39 serve also as members for holding areas near the bent parts of the joint portions 27, 29.

Figure 5:
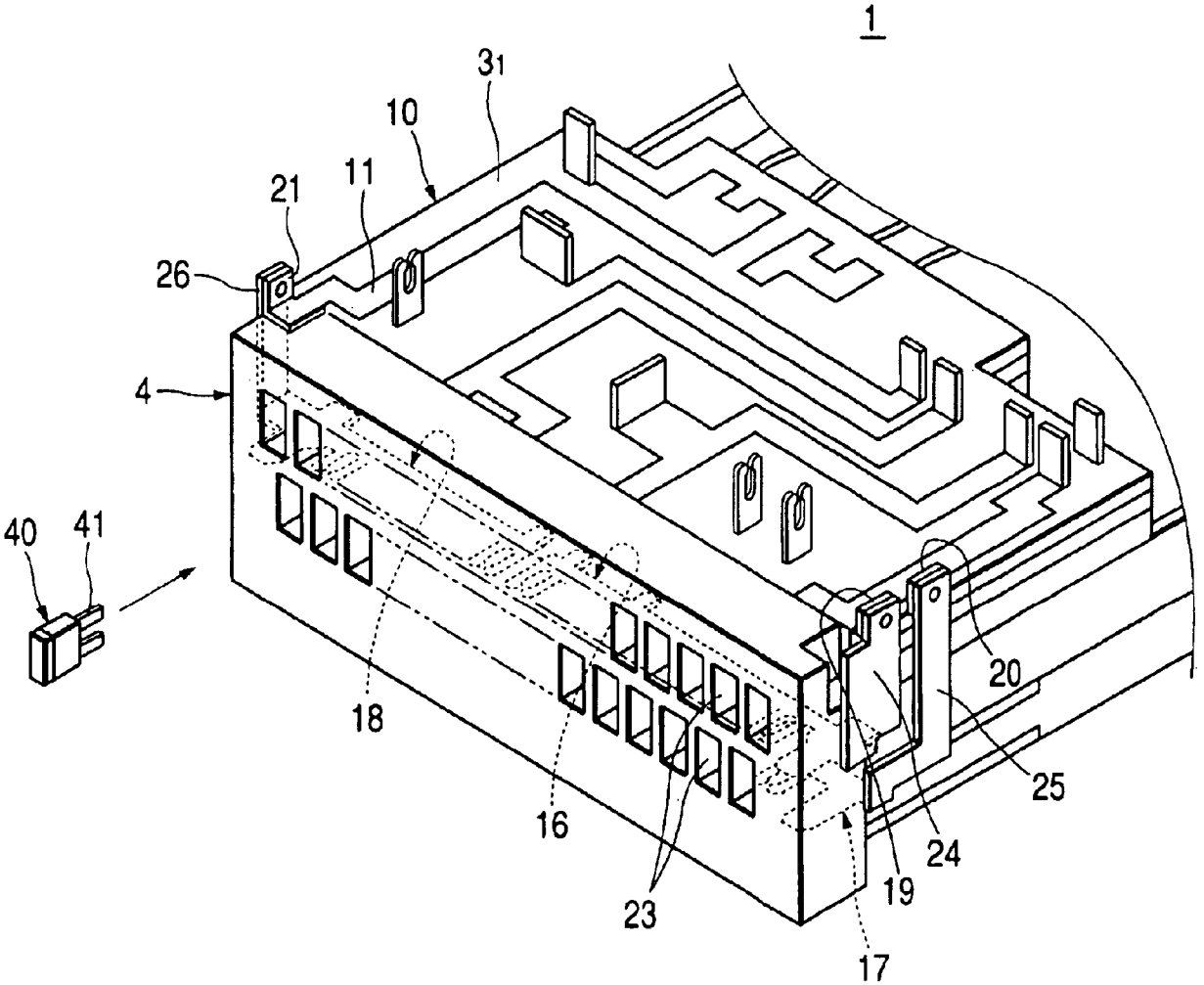
FIG. 5 is a perspective view showing a state that the fuse block is assembled to a circuit board assembly.
Figure 6:
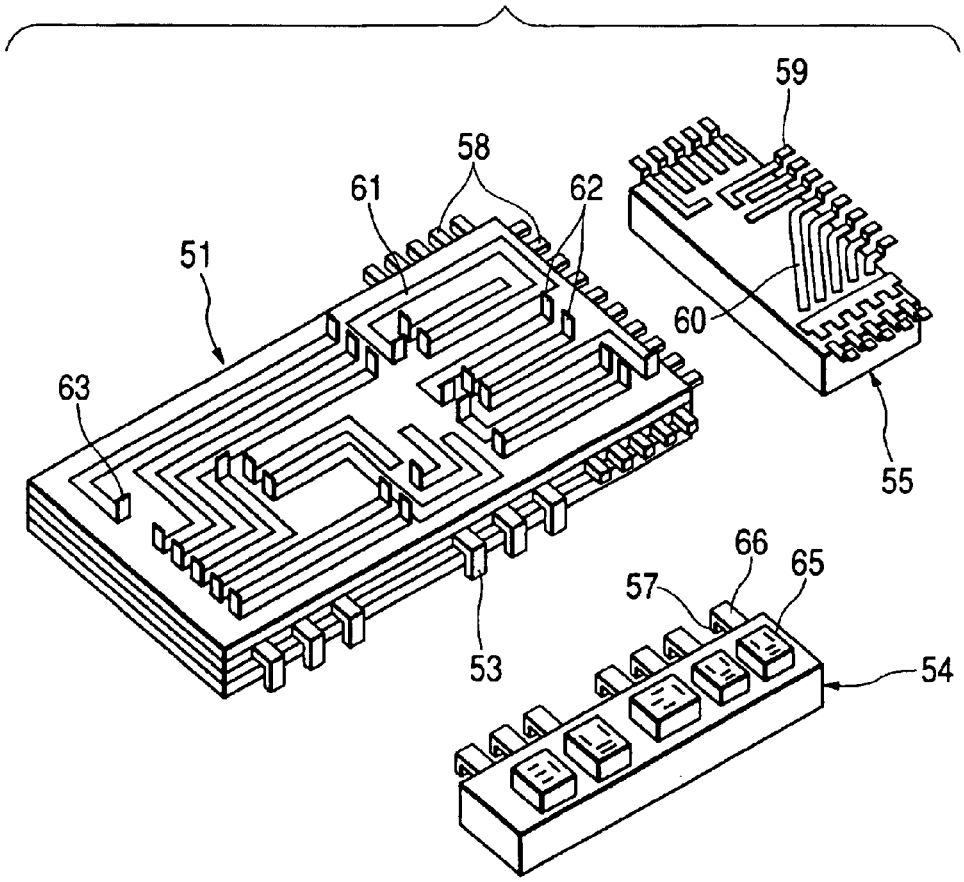
FIG. 6 is an exploded perspective view of a conventional connecting structure of bus bars in an electric junction box.
Figure 7:
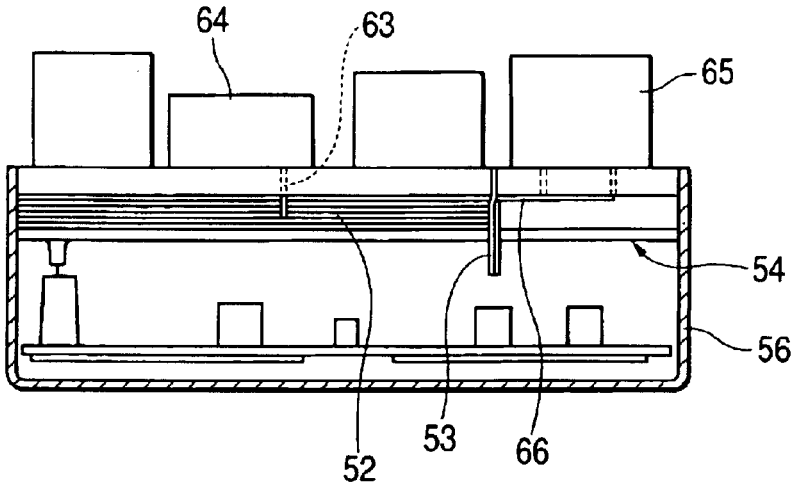
FIG. 7 is a longitudinal sectional view showing the conventional connecting structure.

As shown in FIG. 5, by assembling the fuse block 4 to the circuit board assembly 10, inner faces of the terminal portions 24–26 of the bus bars 16–1B of the fuse block are brought into contact with or placed in proximity to (with slight clearances) outer faces of the terminal portions 19–21 of the bus bars 11 of the circuit board assembly 10. The terminal portions 19–21 and 24–26 protrude higher than the bus bar circuit board $\mathbf{3}_1$ in the uppermost layer, and the top ends of the terminal portions 19–21, 24–26 are positioned at the same height.

The fuse block 4 and the circuit board assembly 10 are aligned with respect to each other by initially engaging the positioning projections 38 (see FIG. 1) with the recesses 39 (see FIG. 2). Then, by inserting the projections 38 into the recesses 39, insertion of the clamping terminals 15 of the circuit board assembly 10 into the fuse block 4 can be performed smoothly, easily and accurately.

On occasion of such assembling, the fuse block 4 is moved toward a front end of the circuit board assembly 10, as shown by the arrow mark A in FIG. 1, so that the clamping terminals 15 are permitted to enter into the fuse chambers 23. In this embodiment, the clamping terminals 15 are positioned at upper and lower parts in the chambers 23 in the upper row, and at lower parts in the chambers 23 in the lower row of the fuse block 4 (except areas where the clamping terminal 30 of the short bus bar 17 is contained).

Because the clamping terminals 30 of the long bus bar 16 of the fuse block 4 are contained in the fuse chambers 23 in the lower row, the bus bars 16–18 of the fuse block and the bus bars 11 of the circuit board assembly 10 are connected to each other by way of a plurality of fuses 40 (see FIG. 5). The short bus bar 17 at the lower side of the fuse block 4 and the long bus bar 16 at the upper side are connected by way of a single fuse 40.

When the fuse block 4 is assembled to the circuit board assembly 10, the terminal portions 24–26 of the bus bars 16–18 of the fuse block move in a direction perpendicular to the thickness direction of the terminal portions, that is, in a widthwise direction of the terminal portions. During the joining operation, the inner faces of the terminal portions 24–26 of the fuse block 4 are slid on the outer faces of terminal portions 19–21 of the circuit board assembly 10 in the widthwise direction of the terminal portion.

Since the widthwise direction of the terminal portions matches with the direction of joining the fuse block 4 and the circuit board assembly 10, both the terminal portions 19–21 and 24–26 are gradually overlapped on each other in the thickness direction thereof, while relatively moving in the widthwise direction thereof, during the joining operation.

According to the above described structure, different from the conventional configuration, the terminal portions will not excessively press with each other in the thickness direction thereof. Therefore, the terminal portions 19–21 and 24–26 will not be deformed nor displaced, and welding work in the next step can be accurately conducted.

Moreover, because the fuse connecting portions 27–29 of the bus bars 16–18 in the fuse block 4 are inserted into the block body 22 in the same direction as the widthwise direction of the terminal portions 24–26. Therefore, when the fuse block 4 is joined to the circuit board assembly 10, even if the terminal portions 19–21 and 24–26 are tightly fitted to each other by elastic forces in the thickness direction thereof (that is, repulsive forces in the thickness direction are accordingly generated), no force will be exerted in a direction to for removing the fuse connecting portions 27–29, and there will be no anxiety that the fuse connecting portions 27–29 may be detached from the fuse block 4.

Further, the clamping terminals 15 of the circuit board assembly 10 are projected and inserted into the fuse block 4 in the widthwise direction of the terminal portions 19–21 and 24–26. Therefore, in a state where the terminal portions 19–21 and 24–26 are in slide contact with each other, the terminals 15 are reliably inserted into the fuse block 4, and there will be no anxiety that incomplete insertion may occur. In the conventional case in which the terminal portions have been abutted against each other in the thickness direction thereof, it is sometimes happened that the terminals 15 are not inserted into the fuse block 4 with a perfect stroke due to variations in projected positions of the terminal portions. In this case, contact between the terminals 15 and the terminals 41 of the fuses 40 (see FIG. 5) in the fuse block will be incomplete.

Both the terminal portions 19–21 and 24–26 are clamped with pressure in the thickness direction thereof by a pair of electrodes (not shown) of a resistance welding machine, and electrically heated to be welded to each other. Since the terminal portions 19–21 and 2426 are projected higher than the circuit board assembly 10, a large space can be obtained for disposing the electrodes, and the welding work can be easily and rapidly conducted. It is also possible to conduct automatic welding, employing an automatic assembling machine.

By welding the terminal portions 19–21 and 24–26, the fuse block 4 is provisionally fixed to the circuit board assembly 10. The sub assembly 1 composed of the fuse block 4 and the circuit board assembly 10 is contained and fixed in upper and lower covers (a main cover and an under cover) which are not shown.

The respective terminal portions 24–26 of the bus bars are located along (in proximity to or in contact with) inner wall faces of the main cover having insulative property, and reliably insulated and protected from the exterior. The front face of the fuse block 4 is exposed to the exterior, and the fuses which are covered with fuse covers so as to be opened and closed are protected in a detachable manner. The fuse 40 (see FIG. 5) has a pair of tab terminals 41 which are clamped between the clamping terminals 15, 30 to be connected therewith.

An electronic control unit (not shown), for example, is disposed underneath of the wiring circuit board 2, and covered with a unit cover (not shown) to be protected. The electric junction box is composed of the circuit board assembly 10, the fuse block 4, the electronic control unit, and the covers. The main cover (not shown) which is positioned in an upper part in FIG. 5 has a plurality of connector housings in which the terminals 8, 13 respectively uprighted from the circuit boards 2, 3 in the upper layers (see FIG. 1) are contained, thereby to constitute a connector. An exterior wire harness (not shown) such as a power source is connected to the connector. The bus bar circuit boards 3 are connected to the electric wires 6 of the wiring circuit boards 2 by way of the press-fitting terminals 14.

The bus bars 11 of the circuit board assembly 10 are connected to the bus bars 16–18 of the fuse block 4 by way of the terminal portions 19–21 and 24–26 for welding connection, enabling both the bus bars 11 and 16–18 to be connected by way of the fuses 40. The bus bars 11 of the circuit board assembly 10 are connected to the tab terminals 8 and the pin-shaped terminals 9 in the connector by way of the electric wires 6, or directly connected to the connector, relays and so on, by the tab terminals 13 of the bus bars 11.

In the above described embodiment, directivity of the electric junction box in vertical, longitudinal, and lateral directions can be appropriately changed according to situations in which the electric junction box is used (a direction of assembling to a vehicle). Moreover, the above described electric junction box is simply one of the examples, and can be appropriately configured according to specifications of the circuits. For example, the electronic control unit may be omitted, the wiring circuit board 2 and the bus bar circuit board 3 may be formed in two layers or more, or only in one layer, and the fuses of the fuse block 4 may be arranged in three steps or in one step. Also according to the specifications of the circuits, either of the front and rear terminals 24, 25 at the right side may be omitted, or the bus bar 18 and the terminal 26 at the left side may be omitted.

Further, it is possible to constitute the circuit board assembly 10 without employing the wiring circuit board 2, but employing only the bus bar circuit board 3. It is also possible to employ a relay block or the like as the electric component block, in place of the fuse block 4. It is also possible to provide the projections 38 as the positioning means on the fuse block 4, and to provide the recesses 39 to be engaged with the projections 38 on the circuit board assembly 10. It is also possible to employ other means such as laser beam welding, soldering, etc. instead of the resistance welding.

What is claimed is:

1. A connection structure in an electric junction box, comprising:

a first assembly, comprising:

a board member, for wiring an electric wire thereon; and a first bus bar, electrically connected to the electric wire, and including a first tab-shaped terminal having a first dimension in a first direction and a second dimension smaller than the first dimension in a second direction perpendicular to the first direction; and a second assembly, joined to the first assembly in the first direction, the second assembly comprising:

a mount section, in which an electric component is mounted; and a second bus bar, electrically connected to the electric component, and including a second tab-shaped terminal having a third dimension in the first direction and a fourth dimension smaller than the third dimension in the second direction, wherein:

the first terminal and the second terminal are arranged so as to be overlapped in the second direction to be welded to each other, after the second assembly is joined to the first assembly, and arranged such that a relative position between the first terminal and the second terminal is gradually changed in the first direction during the joining operation of the first assembly and the second assembly.

2. The connecting structure as set forth in claim 1, wherein:

the second bus bar includes a joint portion continued from the second terminal and extending in the second direction; and the joint portion is fitted into the mount section in the first direction to receive the electric component.

3. The connecting structure as set forth in claim 1, wherein:

the first bus bar includes a third terminal extending in the first direction; and the third terminal is placed in the mount section to receive the electric component when the second assembly is joined to the first assembly.

4. The connecting structure as set forth in claim 1, further comprising a positioning member for determining a relative position between the first assembly and the second assembly.

5. The connecting structure as set forth in claim 1, wherein:

the first terminal is provided at a side end portion of the first assembly in the second direction, and extending in a third direction orthogonal to the first direction and the second direction; and the second terminal is provided at a side end portion of the second assembly in the second direction, and extending in the third direction.

6. The connecting structure as set forth in claim 5, wherein a top end of the first terminal is situated upper than a top face of the first assembly.

7. A method of providing a connection structure in an electric junction box, comprising steps of:

providing a first assembly, comprising:

a board member, for wiring an electric wire thereon; and a first bus bar, electrically connected to the electric wire, and including a first tab-shaped terminal having a first dimension in a first direction and a second dimension smaller than the first dimension in a second direction perpendicular to the first direction; and providing a second assembly, comprising:

a mount section; in which an electric component is mounted; and a second bus bar, electrically connected to the electric component, and including a second tab-shaped terminal having a third dimension in the first direction and a fourth dimension smaller than the third dimension in the direction;

joining the second assembly to the first assembly in the first direction while a relative position between the first terminal and the second terminal is gradually changed in the first direction; and welding the first terminal and the second terminal which are overlapped in the second direction, after the second assembly is joined to the first assembly.

8. The method as set forth in claim 7, wherein:

the first bus bar includes a third terminal extending in the first direction; and the second bus bar includes a joint portion continued from the second terminal and extending in the second direction, the method further comprising steps of:

fitting the joint portion into the mount section in the first direction, before the second assembly is joined to the first assembly; and placing the third terminal in the mount section to receive the electric component when the second assembly is joined to the first assembly.

* * * * *